US012330200B2

(12) United States Patent
Jacimovic

(10) Patent No.: US 12,330,200 B2
(45) Date of Patent: Jun. 17, 2025

(54) DISTRIBUTOR TUBE FOR COOLING METAL STRIPS

(71) Applicant: DANIELI & C. OFFICINE MECCANICHE S.P.A., Buttrio (IT)

(72) Inventor: Nikola Jacimovic, Udine (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 523 days.

(21) Appl. No.: 17/754,872

(22) PCT Filed: Oct. 16, 2020

(86) PCT No.: PCT/IB2020/059744

§ 371 (c)(1),
(2) Date: Apr. 14, 2022

(87) PCT Pub. No.: WO2021/074870

PCT Pub. Date: Apr. 22, 2021

(65) Prior Publication Data

US 2023/0256490 A1 Aug. 17, 2023

(30) Foreign Application Priority Data

Oct. 17, 2019 (IT) ..... 102019000019181

(51) Int. Cl.
*B21B 45/02* (2006.01)

(52) U.S. Cl.
CPC ..... *B21B 45/0218* (2013.01); *B21B 45/0233* (2013.01)

(58) Field of Classification Search
CPC ..... B21B 45/0218; B21B 45/0233
(Continued)

(56) References Cited

U.S. PATENT DOCUMENTS 5,212,975 A * 5/1993 Ginzburg ..... B21B 27/10 72/236
5,579,834 A * 12/1996 Chiba ..... F28F 9/182 165/DIG. 476

(Continued)

FOREIGN PATENT DOCUMENTS

CN 207103444 U * 3/2018 ..... B21B 45/0233
CN 109092911 A 12/2018

(Continued)

OTHER PUBLICATIONS

CN-207103444, Huang et al. , A laminar flow cooling manifold, Mar. 16, 2018 (Year: 2018).*

(Continued)

*Primary Examiner* — Jessee R Roe
*Assistant Examiner* — Michael Aboagye
(74) *Attorney, Agent, or Firm* — Schwegman Lundberg & Woessner, P.A.

(57) ABSTRACT

The invention refers to a distributor tube (400) for cooling metal or similar products, in particular steel strips, comprising along the longitudinal extension of said distributor tube (400), a plurality of outlet openings (406) through which a cooling fluid can be ejected; an inlet (402) and a closure (404) of said tube at its ends; a connection for connecting a source of cooling fluid and feeding said distributor tube (400) with said fluid. At least on the inlet side (402) there is a zone of change in the diameter of the tube, which varies from a sector with a smaller diameter, followed in the direction of flow by a sector with a larger diameter. Upstream of said plurality of outlet openings (406) there is an orifice (414) in the area of the flow section. Further described are a corresponding hot-rolling plant and a use of the distributor tube.

12 Claims, 4 Drawing Sheets

(58) Field of Classification Search
USPC ..... 266/46
See application file for complete search history.

(56) References Cited

U.S. PATENT DOCUMENTS

| | | | | |
|---|---|---|---|---|
| 6,062,056 | A * | 5/2000 | Groch | B21B 45/0233 72/201 |
| 11,534,809 | B2 * | 12/2022 | Hassel | C21D 11/005 |
| 2018/0369887 | A1 | 12/2018 | Min et al. | |

FOREIGN PATENT DOCUMENTS

| | | | |
|---|---|---|---|
| CN | 109092911 | B | 9/2019 |
| DE | 102011007803 | A1 | 9/2012 |
| GB | 2529072 | A | 2/2016 |
| JP | 61162223 | A | 7/1986 |
| JP | 635810 | A | 1/1988 |
| KR | 100797247 | B | 1/2008 |
| KR | 101431033 | B | 8/2014 |
| WO | WO-2018192968 | A1 | 10/2018 |

OTHER PUBLICATIONS

"Chinese Application Serial No. 202080073361.2, Office Action dated Jul. 11, 2023", (Jul. 11, 2023), 8 pgs.
"International Application Serial No. PCT/IB2020/059744, International Search Report dated Feb. 22, 2021", (Feb. 22, 2021), 3 pgs.
"International Application Serial No. PCT/IB2020/059744, Written Opinion dated Feb. 22, 2021", (Feb. 22, 2021), 5 pgs.

* cited by examiner a)

b)

a) STATE OF THE ART b) STATE OF THE ART c) STATE OF THE ART d)

DISTRIBUTOR TUBE FOR COOLING METAL STRIPS

PRIORITY APPLICATIONS

This application is a U.S. National Stage Filing under 35 U.S.C. § 371 from International Application No. PCT/IB2020/059744, filed on Oct. 16, 2020, and published as WO2021/074870 on Apr. 22, 2021, which claims the benefit of priority to Italian Application No. 102019000019181, filed on Oct. 17, 2019; the benefit of priority of each of which is hereby claimed herein, and which applications and publication are hereby incorporated herein by reference in their entireties.

TECHNICAL FIELD

The invention relates to a distributor tube for cooling metal or similar products, in particular steel strips leaving a hot-rolling plant, which comprises a) along the longitudinal extension of the distributor tube a plurality of outlet openings through which a cooling fluid can be ejected;

b) an inlet located at one end of said distributor tube for said cooling fluid and a closure of the distributor tube at the other end, and c) a connection for connecting a source of cooling fluid and feeding said distributor tube with said fluid; wherein at least on the inlet side of said distributor tube there is a zone of change in the diameter of the tube, which varies from a sector with a smaller diameter, followed in the direction of flow by a sector with a larger diameter.

BACKGROUND ART

At the end of hot-rolling, it is necessary to cool the metal strip exiting a rolling plant. The strip is cooled on both the top and bottom surfaces. In particular, distributor tubes are used for the lower cooling, provided with a plurality of spray nozzles normally arranged in a row. Only uniform strip cooling, both in length and width, ensures a strip of excellent geometric and mechanical quality. The state of the art offers a wide range of distributor tubes adapted to obtain more or less uniform cooling of the metal strip. The inventors of the invention described in US 2018/0369887 propose adjusting the cooling provided by the cooling tube based on data received from a flatness meter of the metal strip. A Korean patent, KR100797247B, varies the pressure of the cooling jets during cooling with the use of a valve assembly. In international patent application WO 2018/192968 A1, the proposed solution is to reduce the area of the nozzle pipe section along the longitudinal extension of the tube using diaphragms or slats. The controlled closure of the nozzles involves a complex proposal. In Japan (JP61162223A) a double tube was developed in which both tubes have holes and the size of the outlet opening is adjusted by coaxially rotating one tube in the other. Another complex distributor tube is described in GB 2 529 072 A which is presented as having a double chamber with diverter plates arranged inside the chambers. An additional rotary tube is known from document KR 101431033B. JP S63 5810 A and CN 109 092 911 B show cooling headers with orifices located along the longitudinal extension of the tube.

Often the distributor tubes of the state of the art have reduced diameters in the inlet area. Typical layouts include this transition zone between one diameter and the other near the strip. However, this transition can be critical and lead to an unfavourable distribution of the flow. To overcome this problem, several solutions have been proposed in particular for the distributor tube inlet side, including the preparation of an acute edge between the sector with the smaller diameter and the sector with the larger diameter, a gradual enlargement between one sector and the other or the insertion of a second tube, i.e., a double tube which shows minor deviations of the total pressure and therefore ensures better uniformity.

In terms of cost and efficiency, the solutions disclosed thus far are not yet completely satisfactory, especially due to the non-uniformity of the flow rate and pressure distribution inside the tube. Furthermore, this type of solution prefers fewer parts as much as possible, in order to reduce the production costs of the cooling system.

DISCLOSURE OF THE INVENTION

The invention has the object of overcoming the aforementioned drawbacks and proposing an alternative distributor tube which is constructively simple and inexpensive and at the same time optimizes the efficiency features in terms of fluid dynamics, in particular in terms of uniform flow rate and pressure inside the tube, to obtain a homogeneous cooling of the metal strip relative to the quantities, temperatures, speeds, and pressures of the cooling fluid which reach the strip during the cooling thereof.

The object is achieved by a distributor tube as initially described, which is characterized in that an orifice is provided in the area of the flow section upstream of the plurality of outlet openings. Advantageously, the orifice extends over the entire section of the distributor tube. In a preferred embodiment of the invention, the orifice is located in the sector with the larger diameter.

Compared to double-tube solutions which have an already improved distribution of flow between the outlet openings, preferably created in the form of spray nozzles, and thus a more uniform cooling of the strip, the solution according to the invention is optimized using a simpler, less expensive and very efficient design applicable in a wide range of different plants. In experimental studies as well as flow simulations (studies of the Computational Fluid Dynamics (CFD) type) an orifice installed near the transition zone between small diameter and large diameter shows very satisfactory flow distribution profiles.

Preferably, the orifice is located at a distance of at least 10 cm from the nearest outlet opening. Such a layout further improves the uniformity of the fluid flow.

In a preferred embodiment of the invention, the orifice is a plate provided with a plurality of holes. The plate preferably has the shape of the distributor tube section, generally circular, but other shapes are conceivable. Advantageously, the holes have a diameter in the range of 5 to 10 mm. It is obviously important that the diameter of the holes is sufficient to avoid blocking the main manifold. Excellent results have been obtained with a triangular pitch of the holes. Advantageously, the pitch between a hole and those closest thereto is chosen to be between 7.5 and 15 mm. The term pitch means the distance between the centres of two adjacent holes. Preferably, the free surface, i.e., the sum of the surfaces of the individual cooling fluid passage holes (that is, the aforementioned sum corresponds to the number of holes multiplied by the surface of the single hole), with respect to the inner surface of the distributor tube in the zone of larger diameter, is in the range of 30 to 40%.

In an advantageous embodiment of the invention, the tube and orifice are made of the same material. In most applications, for example, an orifice thickness≤3 mm in accordance with ASME code B31.3 is sufficient, in any case also thicker orifices are suitable. For example, 5 mm thick orifices with 7 holes showed good results. The diameter of the orifice, obviously varies in function of the tube diameter.

Preferably, the openings leaving the distributor tube are arranged on a straight line. In some embodiments of the invention, said openings are provided with small tubes which advantageously direct the outlet of the cooling fluid from the main manifold initially at an angle substantially perpendicular to the longitudinal extension of the distributor tube. However, angled openings with respect to the tube, i.e., angles of less than 90°, are also conceivable.

They are advantageous in terms of uniformity of the flow of openings, i.e., nozzles, which have a greater pressure drop Δp. Increasing and concentrating the pressure drop at the nozzles results in less flow variation there between, but requires greater pressure at the inlet into the manifold.

The number of openings for each tube may vary depending on the width of the strip. An advantageous number is between 22 and 32 for a tube length around 1.5 to 2 m; designs with a higher number of openings have also been used successfully. The uniformity of the flow rates and total pressure to the nozzle inlets is applied as a criterion to identify the best design among the manifolds examined.

A further aspect of the invention concerns a hot-rolling plant, preferably for flat products, comprising in the cooling zone a roller conveyor for transporting the products to be cooled in which at least one distributor tube according to the invention is placed between said rollers. With such an arrangement the strip is cooled on the bottom thereof.

A process according to the invention provides in another aspect of the invention for feeding the distributor tube, particularly in a plant according to the invention, with a cooling liquid exiting from the plurality of openings arranged along the tube to be sprayed onto a freshly rolled metal product to cool it from the bottom.

In a final aspect of the invention, a use is included of a distributor tube or plant according to the invention for cooling strips having a width/thickness ratio ranging from 2000 to 75. This ratio of two dimensions which are units of length (usually expressed in mm) is dimensionless. The features described for one aspect of the invention may be transferred mutatis mutandis to the other aspects of the invention.

The embodiments of the invention described reach the preset objects of the invention. Thanks to the orifice thereof, the proposed distributor tube achieves similar performance to the double tube, which has hitherto been considered the best solution in terms of cooling uniformity, and this in a less complex and more economical manner. The orifice evens the downstream flow, creating a sufficient, but not excessive pressure drop.

The above-mentioned objects and advantages will be further highlighted during the description of a preferred embodiment example of the invention, to be considered by way of example and not of limitation.

Embodiments of the invention are the object of the dependent claims. The description of the preferred embodiment example of the distributor tube, of the hot-rolling plant, of the cooling process of metal strips and of the use of the distributor tube for strips of certain dimensions is given, by way of example and not of limitation, with reference to the attached drawings.

In practice, the materials employed, as well as the dimensions, numbers and shapes, provided that they are compatible with the specific use and not otherwise specified, may be different, according to requirements. In addition, all the details can be replaced by other technically equivalent elements.

DESCRIPTION OF A PREFERRED EMBODIMENT

Figure 1:
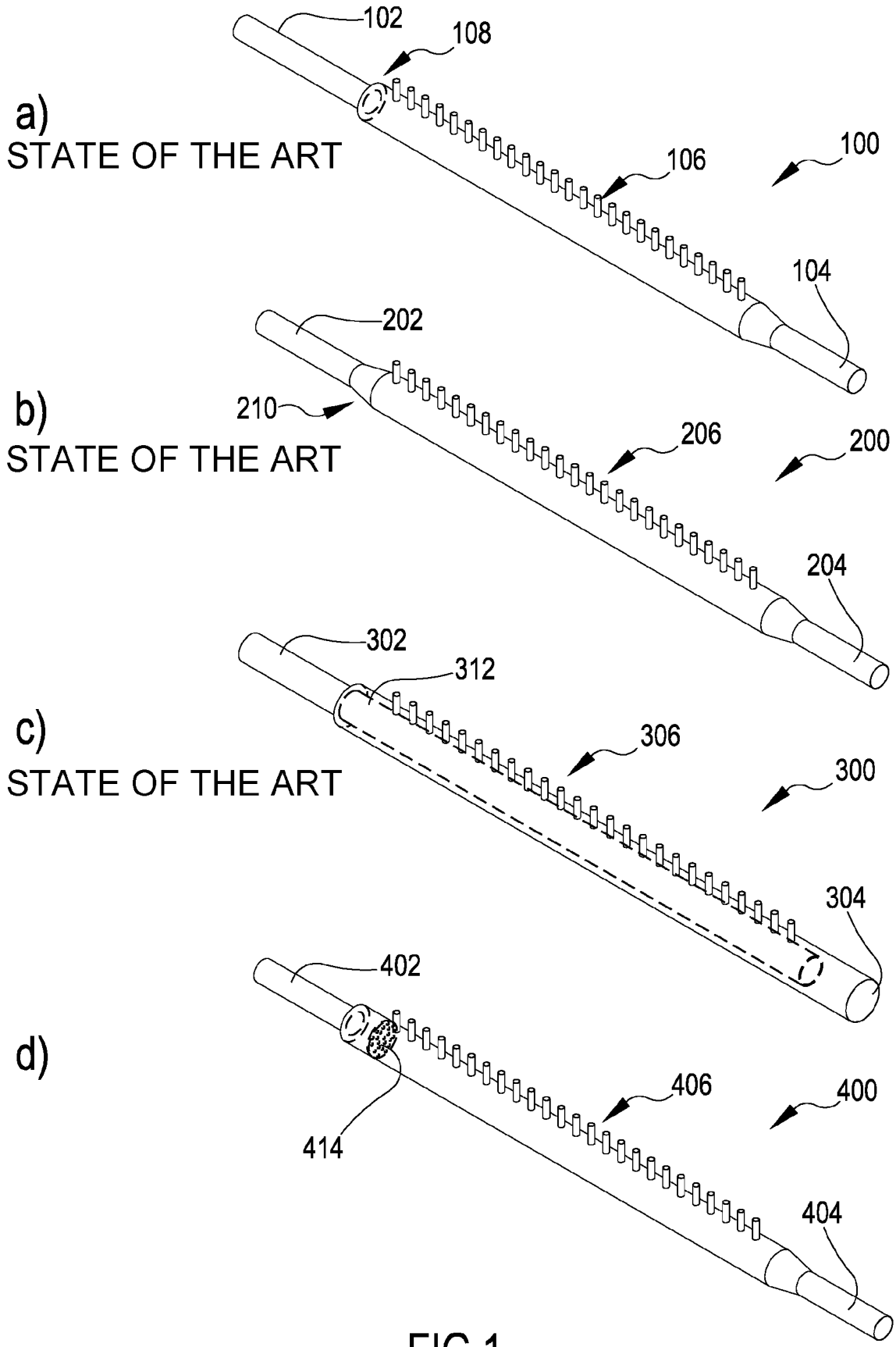
FIG. 1 illustrates in parts a), b) and c) state-of-the-art distributor tubes and in part d) a distributor tube according to the invention.
Figure 3:
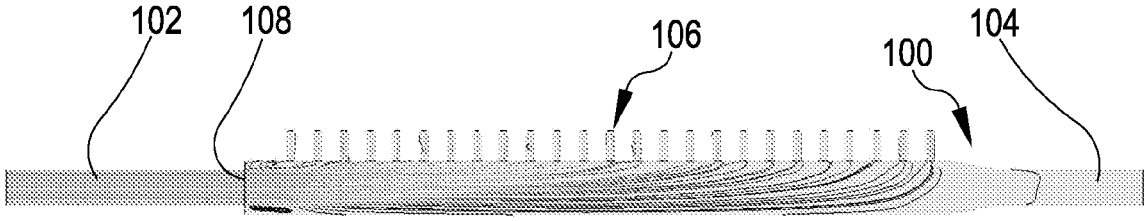
FIG. 3 illustrates a comparison of the flow distributions in the different types of distributor tubes of FIG. 1.
Figure 3:
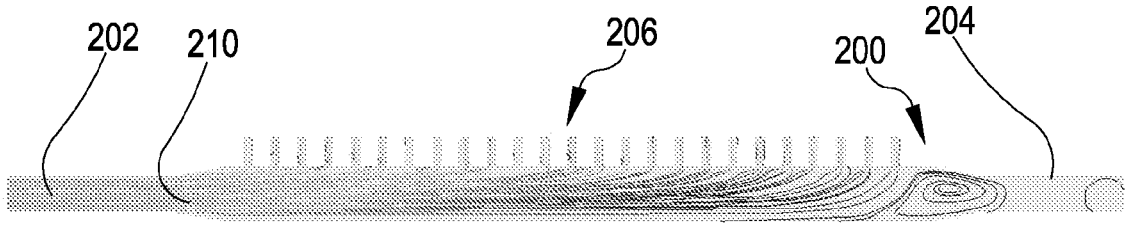
Figure 3:
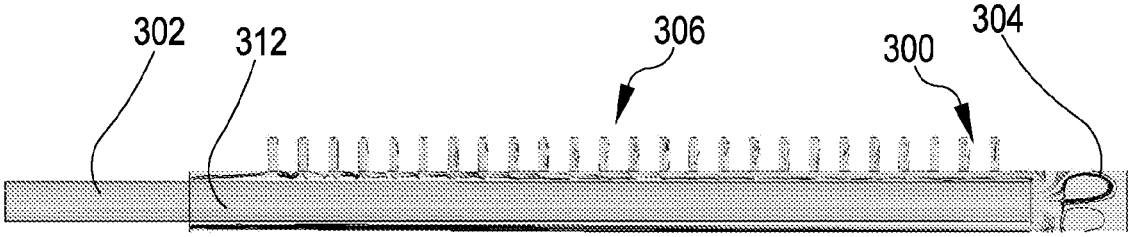
Figure 3:
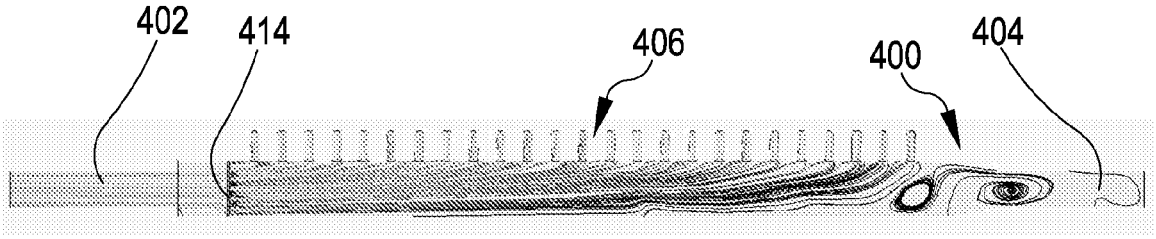
Figure 4:
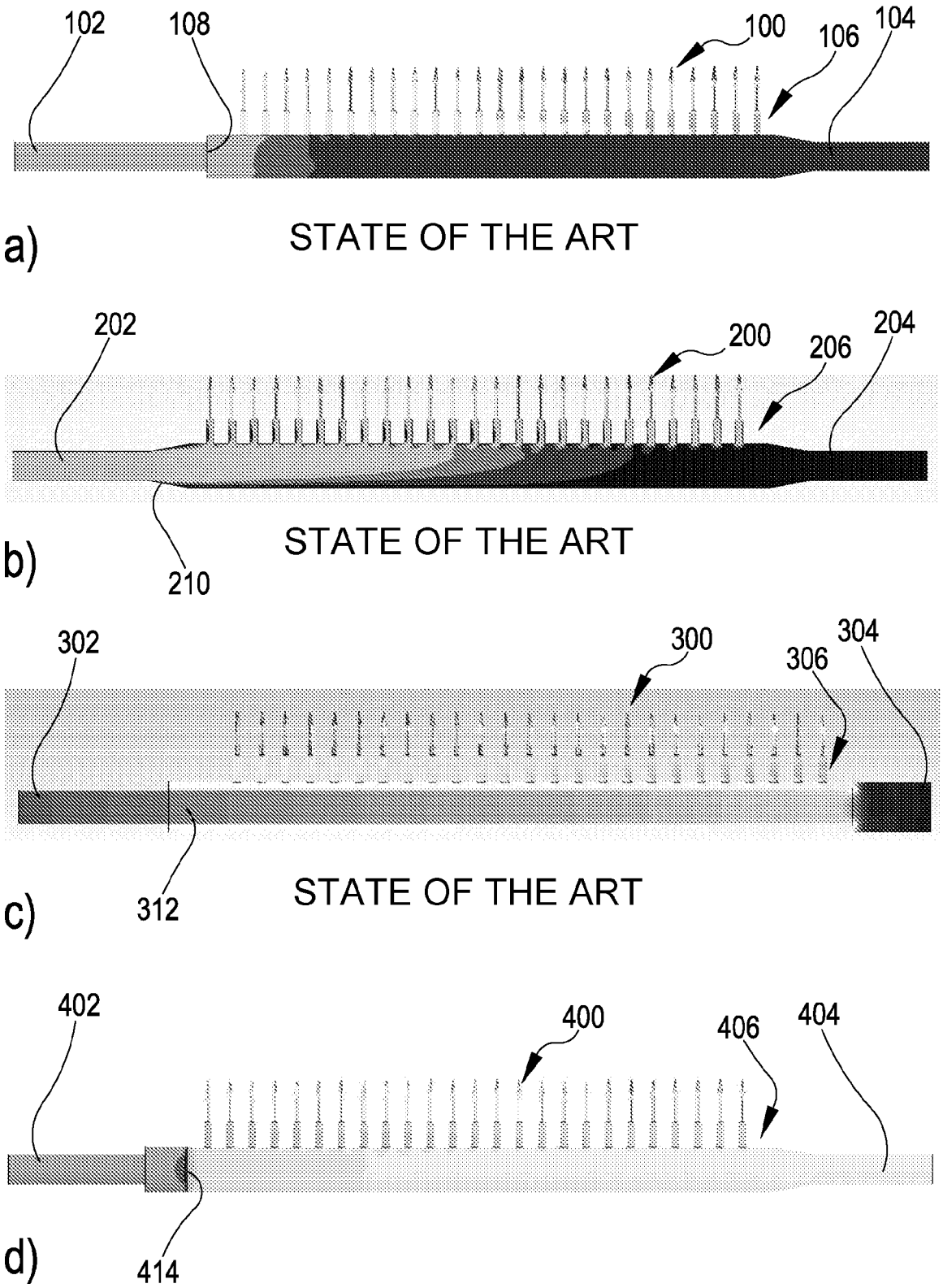
FIG. 4 illustrates a comparison of the static pressure distributions in the different types of distributor tubes of FIG. 1.

In FIGS. 3 and 4 the tubes indicated with a), b), c) and d) correspond to the relative tubes as defined with the relative letters a), b), c) and d) in FIG. 1.

FIG. 1 illustrates in parts a), b) and c) state-of-the-art distributor tubes 100, 200, 300 and in part d) a distributor tube 400 according to the invention. Each tube represented has an inlet 102, 202, 302, 402 and a closure 104, 204, 304, 404, respectively. Along the longitudinal extension of each distributor tube 100, 200, 300, 400 a plurality of nozzles 106, 206, 306, 406 are provided along a straight line. Different solutions are provided in the zones between the transition from a smaller diameter to a larger diameter on the inlet side of the tube. The state of the art provides for an acute edge 108, a gradual enlargement 210 or the creation of a double tube 312 which extends for the entire main manifold, whereby the fluid first travels through the inner tube 312, then rises inwards along the space between the outer tube 300 and the inner tube 312 and exits the nozzles 306. The solution according to the invention, on the other hand, provides for the insertion of an orifice 414 in the distribution tube in the zone with a larger diameter.

Figure 2:
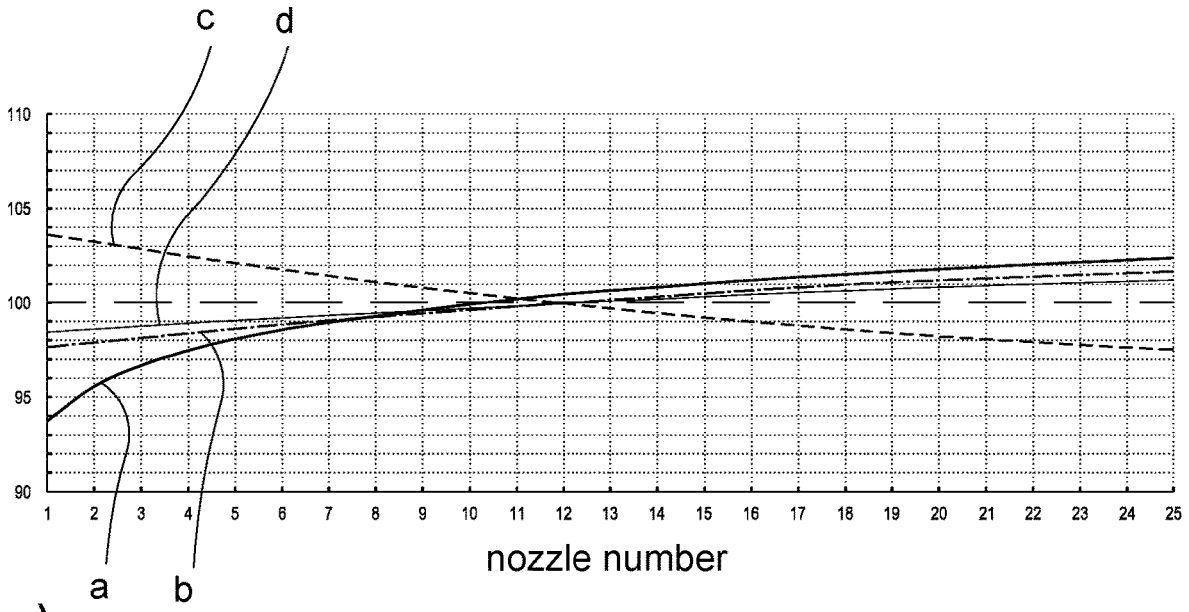
FIG. 2 illustrates in two diagrams a comparison of the flow distribution for the various types of distributor tubes depicted in FIG. 1.
Figure 2:
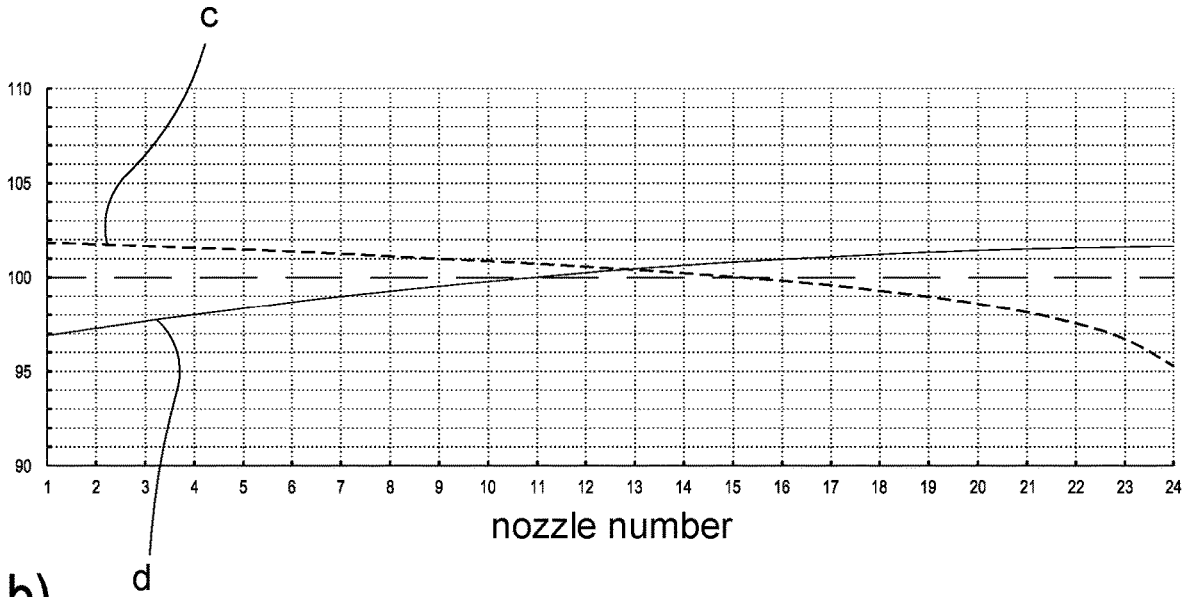

FIG. 2 illustrates in two diagrams a comparison of the flow distribution for the various types of distributor tubes depicted in FIG. 1. The x axis represents the number of nozzles along the distributor tube, the y axis the volumetric flow rate on the nozzle concerned in % with respect to the average volumetric flow rate (100% represents the total manifold flow rate divided by the total number of nozzles). The curves a, b and c of FIG. 2 *a*) indicate for a first type of manifold respectively the trend of the total flow rates along the tube for the state-of-the-art variants a) to c), while the curve d concerns the relative trend of the volumetric flow rates for the orifice solution according to the invention. The flow rates of the figure were attenuated by the least squares method. The profiles for the gradual enlargement and orifice tube are similar with a slight advantage of the tube according to the invention and offer a better volumetric flow rate distribution than the acute-edge tube and the double tube. In FIG. 2 *b*) there is a relative comparison between a double tube (curve c) and a distributor tube according to the invention (curve d) for another type of manifold, the orifice solution is similar and slightly better than the double tube. The double tube is more uniform for the first nozzles and the orifice tube for the last nozzles. In this case, the benefits with respect to the pressure drop are not so important, but the simpler design and better flow rate distribution make the orifice solution preferable. The different profile for the manifold of type c shown in FIGS. 2 *a*) and 2 *b*) results from different end-of-line conditions. In the case of FIG. 2 *a*), the speed in the smaller tube is lower, resulting in a flow stop and return before reaching the blind end of the larger tube. In the case of FIG. 2 *b*), the speed in the smaller tube is higher, converging in a flow which hits the blind end of the wide tube. It can be assumed that the higher the speed in the smaller tube, the worse the flow distribution near the end of the closed tube and vice versa, the lower the speed the better the total distribution in the manifold (especially near the end of the closed tube). There is a pressure unevenness in the nozzles for the acute-edge tube, while in the other tubes it is quite uniform.

FIG. 3 illustrates a comparison of the flow distributions in the different types of distributor tubes of FIG. 1 for a geometry corresponding to that of FIG. 2 *a*). The flow distribution in the tube according to the invention is similar to that of the acute-edge tube and with gradual enlargement, while that of the double tube is different, forcing most of the cooling liquid to pass linearly through the inner tube. The flow speeds change with the grayscale: in particular, the high speeds are the lightest. In the case of acute-edge and gradual enlargement tubes, the speed decreases from the first to the last nozzle, while in the double tube it is lower in the space between the tubes than in the inner tube, but relatively uniform along the length of the inner tube. In the case of the acute edge, the recirculation zones near the edge are created, resulting in a very unfavourable flow distribution in the zone of the first nozzles. In the orifice tube, the speed is fairly uniform throughout the tube.

FIG. 4 illustrates a comparison between the static pressure distributions in the different types of distributor tubes of FIG. 1 with the same geometry which was the basis of the results of FIG. 2 *a*). The darker colours correspond to higher pressures. In the case of the acute-edge tube, the pressure inside the tube increases after the first nozzles to remain fairly constant for the remaining nozzles. In the case of the gradual enlargement tube, the pressure is lower with respect to the tube described above and falls in a manner divided by zones from the beginning to the end of the tube. In the case of the double tube, the pressure decreases slightly inside the inner tube and is lower, but uniform, in the zone between inner and outer tube. Finally, in the orifice tube, the pressure drops considerably immediately after the orifice to stabilize at a stable value after the first nozzles.

Compared to a gradual enlargement tube, an important advantage of the orifice tube is that the proposed solution is relatively independent of the input speed of the main distributor. With high input speeds, the gradual enlargement tube may lead to an unfavourable distribution, especially in the initial zone of the main distributor. The advantages of the orifice tube over a double tube also result from a comparison of the calculated inlet pressures and pressure losses, as shown in table 1 below.

TABLE 1

| solution | relative pressure loss, % |
|---|---|
| With reference to FIG. 2 a) | |
| gradual enlargement tube | 100* |
| acute-edge tube | 104 |
| double tube | 144 |
| orifice tube | 142 |

TABLE 1-continued

| solution | relative pressure loss, % |
|---|---|
| With reference to FIG. 2 b) | |
| double tube | 100* |
| orifice tube | 96 |

*Reference value.

The economical comparison of the double and orifice tube solutions favours the orifice tube. For manifolds with reference to FIG. 2 *b*), the use of the orifice results in estimated savings (compared to a double tube) of more than 2,000 kg of ASTM A312 TP304 steel. Assuming an indicative price of these tubes of €5/kg, the use of orifices would result in material savings of more than €10,000.00.

The invention has achieved the object of proposing a distributor tube with a uniform flow distribution, a simpler design, economic benefits and a sufficient but not excessive pressure drop.

During implementation, further embodiment modifications or variants of the distributor tube, hot-rolling plant and cooling process, object of the invention, not described herein, may be implemented. If such modifications or such variants should fall within the scope of the following claims, they should all be considered protected by the present patent.

The invention claimed is:

1. A distributor tube for cooling metal, leaving a hot-rolling mill comprising:

(a) along a longitudinal extension of said distributor tube, a plurality of outlet openings through which a cooling fluid can be ejected;

(b) an inlet located at one end of said distributor tube for said cooling fluid and a closure of said distributor tube at another end, and (c) a connection for connecting a source of cooling fluid and feeding said distributor tube with said cooling fluid;

wherein at least on an inlet side of said distributor tube there is a zone of change in a diameter of the distributor tube, which varies from a sector with a smaller diameter, followed in a direction of flow by a sector with a larger diameter, wherein upstream of said plurality of outlet openings there is an orifice in an area of a flow section, wherein the orifice is a plate comprising a plurality of holes.

2. The distributor tube according to claim 1, wherein the plurality of holes have a diameter in a range of 5 to 10 mm.

3. The distributor tube according to claim 2, wherein the plurality of holes are arranged in a triangular pitch.

4. The distributor tube according to claim 3, wherein the pitch between adjacent holes is between 7.5 and 15 mm.

5. The distributor tube according to claim 1, wherein a ratio of a sum of surfaces of the plurality of holes of the orifice to an internal surface of the distributor tube in an area of larger diameter, is in a range from 30 to 40%.

6. The distributor tube according to claim 1, wherein the plurality of outlet openings are arranged on a straight line.

7. The distributor tube according to claim 1, wherein said orifice is located in said sector with larger diameter.

8. The distributor tube according to claim 1, wherein a number of the plurality of outlet openings is in a range from 22 and 32 for a tube length in a range of from 1.5 to 2 m.

9. The distributor tube according to claim 1, wherein the orifice is located at a distance of at least 10 cm from a nearest outlet opening.

10. A hot-rolling plant comprising in a cooling zone;

a roller conveyor for a transport of a product to be cooled, wherein at least one distributor tube according to anyone of the preceding claims is placed between rollers of the roller conveyor.

11. The hot-rolling plant of claim 10, wherein the product to be cooled includes a strip having a width/thickness ratio ranging from 2000 to 75.

12. The distributor tube of claim 1, wherein the metal comprises a steel strip.

* * * * *